US005275008A

United States Patent [19]

Song et al.

[11] Patent Number: 5,275,008

[45] Date of Patent: Jan. 4, 1994

[54] AIR CONDITIONER WITH AUXILLARY CONDENSER DEFROST

[75] Inventors: Yun K. Song, Seoul; Geun P. Han, Kyungki, both of Rep. of Korea

[73] Assignee: Samsung Electronics Co., Ltd., Suwon City, Rep. of Korea

[21] Appl. No.: 974,233

[22] Filed: Nov. 10, 1992

[30] Foreign Application Priority Data

Dec. 11, 1991 [KR] Rep. of Korea ..... 91022685

[51] Int. Cl.[5] ..... F25B 41/00

[52] U.S. Cl. ..... 62/81; 62/277; 62/278; 62/324.5; 62/324.6

[58] Field of Search ..... 62/80, 81, 151, 277, 62/278, 324.5, 324.6

[56] References Cited

U.S. PATENT DOCUMENTS 4,332,137 6/1982 Hayes, Jr. ..... 62/81

4,774,813 10/1988 Yokoyama ..... 62/81

*Primary Examiner*—John M. Sollecito

*Attorney, Agent, or Firm*—Burns, Doane, Swecker & Mathis

[57] ABSTRACT

During the heating cycle of an air conditioning system, a portion of the compressed refrigerant is conducted between outdoor and indoor heat exchangers for heating a dwelling, and another portion of the compressed refrigerant is conducted to an auxiliary condenser. Heat from the auxiliary condenser is directed against the outdoor heat exchanger to defrost the latter.

9 Claims, 2 Drawing Sheets

AIR CONDITIONER WITH AUXILLARY CONDENSER DEFROST

BACKGROUND OF THE INVENTION

The invention relates to a single apparatus air conditioner which performs selectively either a heating mode of operation or a cooling mode of operation through the use of a heat pump cycle.

In most cases, a conventional air conditioner repeatedly performs a serial process of compression, condensation, expansion and evaporation so as to achieve a cooling mode of operation, while the process is reversed so as to achieve a heating mode of operation.

However, because the air conditioner performs a heating operation when the temperature of the outdoor air is lower than the indoor air, the outdoor heat exchanger i.e. the condenser collects frost on the surface of the outdoor heat exchanger. The phenomena necessitates a defrost process and the operation of the heating cycle stops in order to temporarily reverse the heating cycle into a cooling cycle in order to defrost the outside unit. After the frost on the outdoor heat exchanger is melted the operation of the cooling cycle returns to the heating cycle. Alternatively, an individual defrost apparatus could be installed.

In the process of using the reverse cycle, combined with the accompanying cooling operation, a temporary stop in the heating operation decreases not only the heating efficiency but also the rate of the defrost action.

In the utilization of an individual defrost apparatus, another problem is that an additional power source is required.

In order to solve some of the problems mentioned above, a prior art air conditioner system provides an auxiliary condenser adjacent to the outdoor heat exchanger. During a break in the heating operation, the auxiliary condenser receives a part or all of the refrigerant compressed by a compressor. The heat of the refrigerant is then used to melt the frost on the outdoor heat exchanger. However, the process can be performed only during a temporary break in the heating operation, and there is thus no continuous (i.e., high efficiency) heating operation when using this expedient. This results in additional problems because the efficiency of the air conditioner is decreased.

SUMMARY OF THE INVENTION

One object of the invention is to provide an air conditioner which performs a continuous defrost operation during the heating operation without stoppingg the heating operation in order to operate the heating cycle in reverse, thereby achieving an increased heating efficiency.

According to an aspect of the present invention, an air conditioner is provided which comprises a compressor, an indoor heat exchanger, expansion tube and an outdoor heat exchanger connected in series with a refrigerant tube. Further, the air conditioner comprises a four way valve interconnected with an inlet and an outlet of the compressor, a first three way valve connected in parallel with a refrigerant tube connected to the compressor and the indoor heat exchanger and a refrigerant tube connected to the compressor and the outdoor heat exchanger, an auxiliary condenser connected with an outlet of the first three way valve, and a second three way valve connected with an outlet of the auxiliary condenser, and the second three way valve connected in parallel with the expansion tube.

Furthermore, the ratios between the heat transfer area of the indoor heat exchanger, the outdoor heat exchanger and the auxiliary condenser are 1:1:0.2~0.4.

The air conditioner described above is operated as follows:

The refrigerant is compressed by a compressor and it is directed to perform either a cooling cycle or a heating cycle;

In the cooling mode, the compressed refrigerant is simultaneously directed to an outdoor heat exchanger and an auxiliary condenser;

The refrigerant is directed to flow through the auxiliary condenser to combine with the refrigerant that flowed through the outdoor heat exchanger and the combined refrigerant is directed to an expansion tube;

The refrigerant is directed to flow through the expansion tube to the compressor via an indoor heat exchanger; or In the heating mode, the compressed refrigerant is simultaneously directed to an indoor heat exchanger and an auxiliary condenser;

The refrigerant is directed to flow through the auxiliary condenser to combine with the refrigerant that flowed through the indoor heat exchanger and the combined refrigerant is directed to an expansion tube; and The refrigerant is directed to flow through the expansion tube to the compressor via an outdoor heat exchanger.

Therefore, in the heating mode, the high temperature refrigerant under high pressure flows into the auxiliary condenser as well as the indoor heat exchanger. The heat of the auxiliary condenser melts the frost which is formed on the outdoor heat exchanger by the temperature difference between temperature of the outdoor heat exchanger and that of the outdoor air. As described above, in the heat mode the heat cycle is not interrupted and an additional defrost apparatus does not need to be installed around the outdoor heat exchanger in order to melt the frost on the outdoor heat exchanger.

BRIEF DESCRIPTION OF THE DRAWINGS

The invention will now be explained with reference to the accompanying drawings in which.

EXPLANATION OF THE PREFERRED EMBODIMENTS

Figure 1:
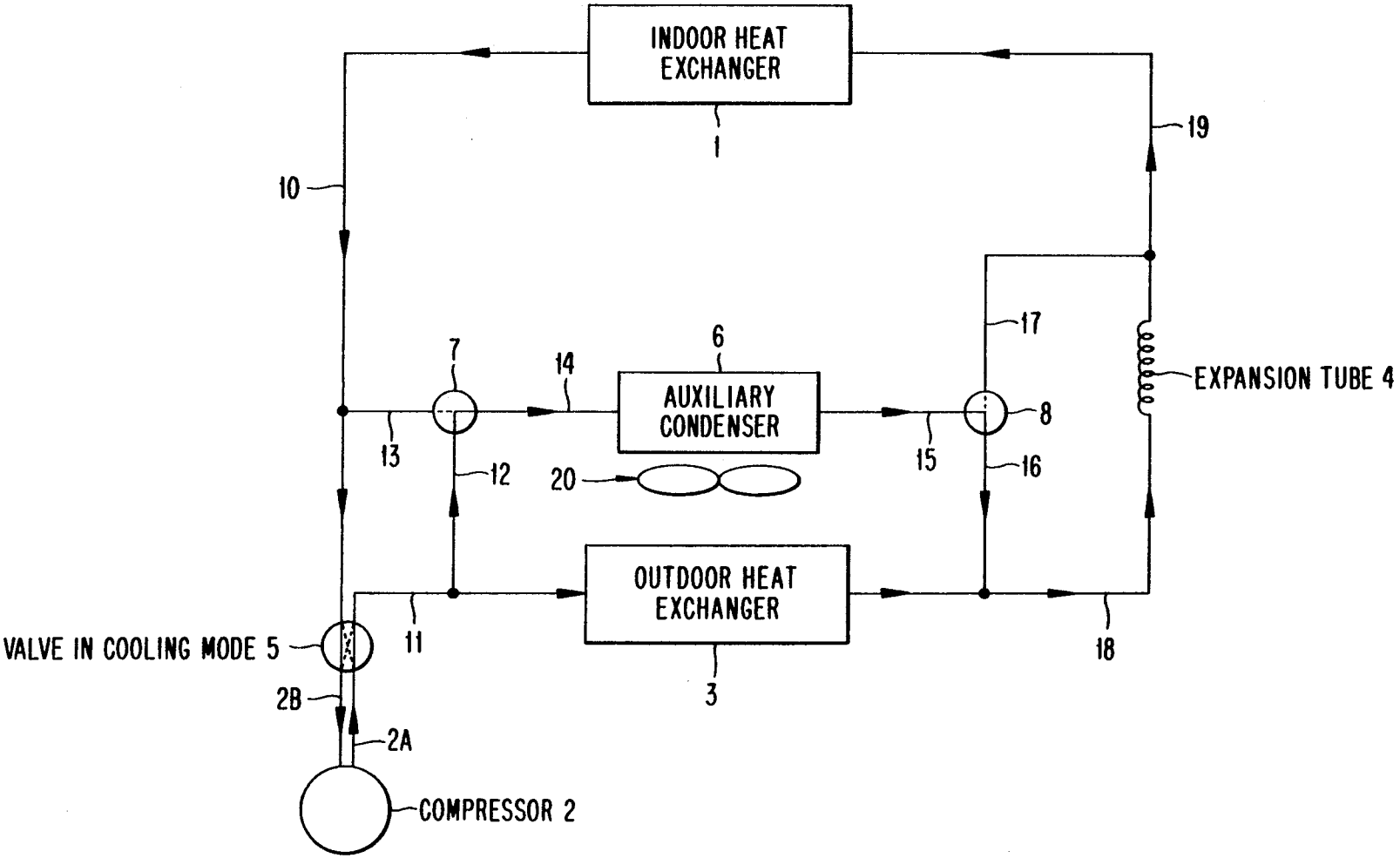
FIG. 1 is a schematic diagram conceptionally illustrating the invention showing the cooling mode of operation.
Figure 2:
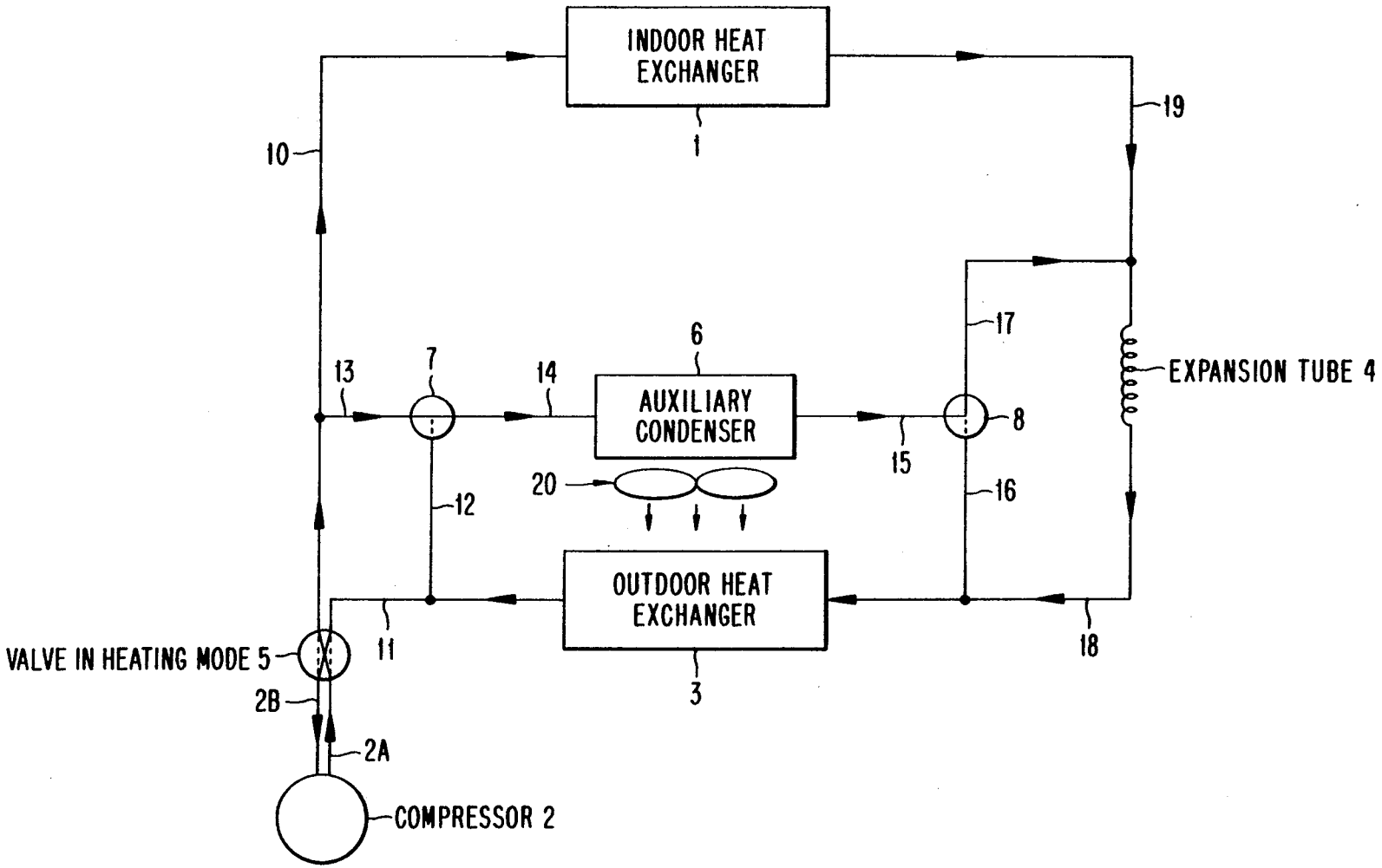
FIG. 2 is a schematic diagram conceptionally illustrating the invention showing the heating mode of operation.

FIGS. 1 and 2 represent the schematic diagram of the air conditioner according to the invention. The air conditioner comprises an indoor heat exchanger 1 located at an indoor location, a compressor 2 located at an outdoor location, an outdoor heat exchanger 3 located at an outdoor location, and an expansion tube 4 which serves as a pressure reducing device. The components are serially connected through a refrigerant tube. A four way valve 5 is mounted to both an inlet and an outlet of the compressor 2 in such a manner that the refrigerant circulates along a cooling cycle or a heating cycle, depending on the flow selection of the four way valve 5. Further, adjacent to the outdoor heat exchanger 3 an auxiliary condenser 6 is provided. Furthermore, three way valve 7 and three way valve 8 are located respectively at the inlet and the outlet of the auxiliary condenser 6. One tube 13 branches from the refrigerant tube 10 and connects the compressor 2 with the auxiliary condenser 6, while another tube 12 branches from the refrigerant tube 11 and connects the compressor 2 with the outdoor heat exchanger 3. At the junction point where tubes 12 and 13 intersect, the three way valve 7 is located for selecting the flow direction, i.e. 12 or 13, fed into the first three way valve 3. The three way valve 7 is also connected to the auxiliary condenser 6. The tube 15 extending from the auxiliary condenser 6 is connected to the three way valve 8. Tube 17 branches from the three way valve 8 and connects to the tube 19 which connects the expansion tube 4 with the indoor heat exchanger 1, while tube 16 branches from the three way valve 8 and connects to tube 18 which connects the expansion tube 4 and the outdoor heat exchanger 3. The three way valve 8 selects the flow direction, i.e. 16 or 17, fed throughout the second three way valve 8.

In the cooling mode, shown by arrows in FIG. 1 the four way valve 5 is set in a parallel pattern such that the outlet tube 2A connects to the tube 11 and the inlet tube 2B connects to the tube 10. Tube 13, connected to three way valve 7, closes such that the tube 12 connects to the tube 14. Tube 17, connected to three way valve 8, closes such that the tube 15 connects to the tube 16. The refrigerant that is compressed by the compressor 2 flows into both the auxiliary condenser 6 through the three way valve 7 as well as into the outdoor heat exchanger 3. During this process, the outdoor heat exchanger 3 serves as a condenser. The outflow in the tube 15 joins the mainflow in the tube 18, which connects the outdoor heat exchanger 3 and the expansion tube 4 via the three way valve 8. The combined flow passes through the expansion tube 4 and goes into the indoor heat exchanger 1, i.e. the evaporator. The refrigerant then flows back to the compressor 2. According to the above cycle, the cooling operation is performed.

In the heating mode, shown by arrows in FIG. 2, the four way valve 5 is set in a cross pattern such that the outlet tube 2A connects to the tube 10 and the inlet tube 2B connects to the tube 11. The tube 12 of the three way valve 7 closes such that the tube 13 connects to the tube 14. The tube 16 of the three way valve 8 closes such that the tube 15 connects to the tube 17. The refrigerant compressed by the compressor 2 flows into the auxiliary condenser 8 through the three way valve 7 as well as flowing to the indoor heat exchanger 1. During this process the indoor heat exchanger 1 serves as a condenser. The outflow in the tube 15 joins together with the mainflow in the tube 19, which connects the indoor heat exchanger 1 and the expansion tube 4 via the three way valve 8. The combined flow passes through the expansion tube 4 and is fed into the outdoor heat exchanger 3, i.e. the evaporator. The refrigerant then returns to the compressor 2. According to the above cycle, the heat operation is performed. Due to the fact that the surrounding temperature is lower, frost develops on the surface of the outdoor heat exchanger 3, i.e. the evaporator. The air produced by the heat, of the auxiliary condenser 6 is blown by a substantial fan 20 so as to melt the frost.

To increase the efficiency of the heat exchanger, it is known that the ratio of the heat transfer area of the evaporator compared to that of the condenser is 1:1.2 ~1.4. In this embodiment, the heat transfer area of the indoor heat exchanger is designated as 1 and the outdoor heat exchanger is 1, and that of the auxiliary condenser is 0.2~0.4. Therefore, in both the heating mode as well as in the cooling mode, the ratio of the heat transfer area of the evaporator compared to that of the condenser is always 1:1.2~1.4.

The present invention provides a heat exchanger that performs a continuous defrost function during the heating operation without interrupting the heating operation and reverse-flowing the heating cycle, thereby achieving a high efficiency of heating.

What is claimed:

1. A heating system comprising:

a compressor for compressing refrigerant, an indoor heat exchanger, an expansion tube, and an outdoor heat exchange all connected in series with said compressor for receiving a first portion of refrigerant compressed thereby, an auxiliary condenser having an inlet connected to receive a second portion of said refrigerant compressed by said compressor, and an outlet connected to discharge said second portion of said refrigerant into combination with said first portion of said refrigerant at a location upstream of said expansion tube, means for conducting the combined first and second portions of refrigerant into said expansion tube, and heat directing means for directing heat from said auxiliary condenser to said outdoor heat exchanger to defrost the latter.

2. A heating system according to claim 1 wherein said heat directing means comprises a fan.

3. A heating system according to claim 1, wherein the ratios between the heat transfer areas of said indoor heat exchanger, said outdoor heat exchanger, and said auxiliary condenser are 1:1:x, wherein x is between 0.2 and 0.4.

4. An air conditioning system selectively actuable in cooling and heating cycles, comprising:

a compressor;

an auxiliary condenser;

indoor and outdoor heat exchangers;

first valve means connected to said compressor for directing compressed refrigerant selectively to an inlet of said outdoor heat exchanger during said cooling cycle, and to an inlet of said indoor heat exchanger during said heating cycle, second valve means for selectively:

connecting an inlet of said auxiliary condenser to an inlet of said outdoor heat exchanger during said cooling cycle so that compressed refrigerant is directed to said auxiliary condenser and said outdoor heat exchanger during said cooling cycle, and connecting an inlet of said auxiliary condenser to an inlet of said indoor heat exchanger during said heating cycle so that compressed refrigerant is directed to said auxiliary condenser and said indoor heat exchanger simultaneously during said heating cycle;

third valve means for selectively:

connecting an outlet of said auxiliary condenser with an outlet of said outdoor heat exchanger during said cooling cycle, and connecting an outlet of said auxiliary condenser with an outlet of said indoor heat exchanger during said heating cycle; and an expansion tube connected between said indoor and outdoor heat exchangers so that combined refrigerant from said auxiliary condenser and said outdoor heat exchanger is directed through said expansion tube during said cooling cycle, and combined refrigerant from said auxiliary condenser and said indoor heat exchanger is directed through said expansion tube during said heating cycle.

5. An air conditioner system according to claim 4 including heat directing means for directing heat from said auxiliary condenser to said outdoor heat exchanger during said heating cycle to defrost said outdoor heat exchanger.

6. An air conditioner system according to claim 5, wherein said heat directing means comprises a fan.

7. An air conditioner system according to claim 5, wherein the ratios between the heat transfer areas of said indoor heat exchanger, said outdoor heat exchanger, and said auxiliary condenser are 1:1:x, wherein x is between 0.2 and 0.4.

8. A method of operating an air conditioning system in a heating cycle comprising the steps of:

A) directing a first portion of compressed refrigerant from a compressor sequentially to an indoor heat exchanger, an expansion tube, an outdoor heat exchanger, and back to said compressor, B) directing a second portion of compressed refrigerant from said compressor to an inlet of an auxiliary condenser simultaneously with Step A, C) combining, at a location upstream of said expansion tube, refrigerant exiting said auxiliary condenser and said indoor heat exchanger, and D) directing heat from said auxiliary condenser to said outdoor heat exchanger to defrost the latter.

9. A method according to claim 8, wherein Step D comprises actuating a fan.

* * * * *